United States Patent [19]

Wilson et al.

[11] Patent Number: 5,054,959

[45] Date of Patent: Oct. 8, 1991

[54] LINE MARKING APPARATUS

[75] Inventors: James B. S. Wilson, Vermont; Robert J. Milligan, Montmorency; Alan J. Loughron, Murrumbeena, all of Australia

[73] Assignee: Road Construction Authority, Victoria, Australia

[21] Appl. No.: 638,839

[22] PCT Filed: Nov. 30, 1983

[86] PCT No.: PCT/AU83/00175

§ 371 Date: Nov. 30, 1984

§ 102(e) Date: Nov. 30, 1984

[87] PCT Pub. No.: WO84/02150

PCT Pub. Date: Jun. 7, 1984

[30] Foreign Application Priority Data

Nov. 30, 1982 [AU] Australia ..... 7043/82

[51] Int. Cl.[5] ..... E01C 23/16

[52] U.S. Cl. ..... 404/94; 239/150

[58] Field of Search ..... 404/84, 94; 239/150, 239/159, 172; 118/305; 222/611

[56] References Cited

U.S. PATENT DOCUMENTS

| | | | |
|---|---|---|---|
| 2,691,923 | 10/1954 | Huck | 404/94 |
| 2,756,103 | 7/1956 | Creswell | 404/94 X |
| 3,046,854 | 7/1962 | Wilson | 404/94 |
| 3,092,325 | 6/1963 | Brown, Jr. et al. | 239/150 X |
| 3,101,175 | 8/1963 | Brown, Jr. | 239/150 |
| 3,229,660 | 1/1966 | McLucas et al. | 118/305 X |
| 3,286,928 | 11/1966 | Mitchell | 239/150 |
| 3,298,352 | 1/1967 | Vrablik | 118/305 X |
| 3,326,098 | 6/1967 | Boettler | 404/94 X |
| 3,477,352 | 11/1969 | Harding et al. | 404/94 |
| 3,632,042 | 1/1972 | Goulish et al. | 239/139 X |
| 3,825,185 | 7/1974 | Moon et al. | 239/150 |
| 3,882,268 | 5/1975 | Ogawa et al. | 239/150 X |
| 4,288,034 | 9/1981 | Widmer et al. | 239/159 X |

FOREIGN PATENT DOCUMENTS

| | | | |
|---|---|---|---|
| 1290159 | 1/1966 | Fed. Rep. of Germany | 404/94 |
| 1658568 | 12/1970 | Fed. Rep. of Germany | 404/94 |
| 1658569 | 12/1970 | Fed. Rep. of Germany | 404/94 |

*Primary Examiner*—Ramon S. Britts
*Assistant Examiner*—Matthew Smith
*Attorney, Agent, or Firm*—Buchanan Ingersoll

[57] ABSTRACT

Pavement line marking apparatus adapted to detect old line markings on a pavement surface and to repaint such markings or alternatively to paint new line markings to a desired pattern, the apparatus comprising a support beam (11) with a marking detection element (80) arranged at one end such that any old line markings are detectable thereby, upon movement of the detection element 80 over the desired pavement surface, paint applicator means (75,76) arranged mounted from the support boom rearwardly from the marking detection element (80) for movement transversely of the direction of movement of the support boom (11) along the desired pavement surface, and control means actuable in response to a signal from the marking detection element to move said paint applicator means to a position over the old line markings and to operate the paint applicator means to deposit paint along the old line markings on the pavement surface.

2 Claims, 9 Drawing Sheets

LINE MARKING APPARATUS

The present invention relates to apparatus for line marking roadways or the like. Typically the apparatus is intended to paint or repaint centre lines (both broken, solid or any combination thereof) and left and right hand roadway edge lines.

Conveniently line marking machines of this general type have either been manual or semi manual in operation. The speed of operation of such machines have depended on the ability of the operator to accurately push buttons to turn on and off spray guns to deposit paint at the required locations while at the same time accurately steering the machine to have the paint spray guns accurately over the existing lines, or in the right position on the roadway surface. Generally such machines have been unable to exceed about 20 km/hr.

The objective of the present invention is to provide apparatus capable of line marking roadways at speeds substantially above those possible with existing machines. It is believed that speeds of up to 80 km/hr may be obtained subject to road speed limits and the apparatus according to this invention has been operated at speeds of 60 km/hr. At this speed a conventional broken centre line having a 3 meter stripe and a 9 meter gap as one cycle will pass underneath the paint spray guns in approximately 1 second, that is the spray guns will be on for 0.21 seconds and will be off for 0.65 seconds. It is naturally appreciated that these time periods make it impossible for any manual operation of turning on or off the spray guns accurately. Moreover, it is extremely difficult to steer accurately following a desired line and the difficulty of this is greatly increased with increased speeds of operation.

The present invention provides a pavement line marking apparatus comprising a support means arranged to travel along said pavement in a predetermined direction, said support means carrying a marking detection element adapted to maintain surveillance of an area of pavement traversed by said detection element and paint applicator means being carried rearwardly by said marking detection element with respect to the direction of travel of said apparatus, said paint applicator means being arranged for movement in a generally transverse direction relative to said direction of travel, and said marking detection means being adapted to sense a marking on the pavement surface traversed by said detection means to thereby control movement and positioning of said paint applicator means. Conveniently the support means may comprise a boom extending forwardly of a vehicle adapted to move said boom along said pavement, said marking detection means being located at a free end of said boom and said paint applicator means being located at an intermediate position along said boom. The boom may, however be supported elsewhere from the operating vehicle such as on either side or extending rearwardly from the vehicle. A support element may be provided pivoted at a first end to said boom for movement about a generally vertical axis with said support element extending in a plane generally parallel to and beneath said boom, said paint applicator means being arranged for movement with said support element adjacent to the second end of said support element distant from said pivot connection to the boom. Conveniently the paint applicator means are mounted to a transversely extending carrier pivoted to the second end of the support element for movement about a generally vertical axis, said apparatus further including a second rigid connecting element pivoted at one end to said carrier and at a second end to said boom whereby said carrier, said support element, said connecting element and said boom form a parallelogram linkage such that upon pivoting of said support element about its pivot connection to said boom, said carrier for the paint applicator means is maintained generally perpendicular to said boom.

Preferably the marking detection means includes a line scan camera having a field of view extending transversely across the intended path of travel of said apparatus, said camera being located within a housing having a substantially open lower face permitting said camera to view the pavement traversed, and an independent light source within said housing to provide a substantially constant light source to the pavement region traversed by said housing. The apparatus may also include data processing control means adapted to receive signals from said camera and to generate in response thereto control signals directed to said paint applicator means to both correctly position and turn on and off said paint applicator means.

Advantageously the boom forming the support means is connected to the forward end of the vehicle in a manner enabling vertical pivotting movement about a horizontal axis, the boom being supported adjacent its forward end by a castor wheel or similar ground engaging element. In other embodiments the boom may be mounted from a position underneath the vehicle or alternatively could be mounted along either side of the vehicle such that the boom extends generally parallel to a desired side of the vehicle. For example, the boom might be pivotally mounted at a rear side portion of the vehicle.

According to a further aspect of the present invention there is provided a system for storing paint ready for use in apparatus of the aforementioned kind. The paint storage system comprises at least two separate paint containers each having agitator means for continuous or substantially continuous agitation of the paint in the containers, each of said paint containers being located within a common external jacket and means being provided to circulate hot water through said jacket and around the paint containers to maintain the temperature of the paint at a desired level ready for use. Conveniently the water circulated through the jacket is hot water from the vehicle engine cooling system.

The invention will be better understood from the following description of preferred arrangements given in relation to the accompanying drawings.

Figure 1:
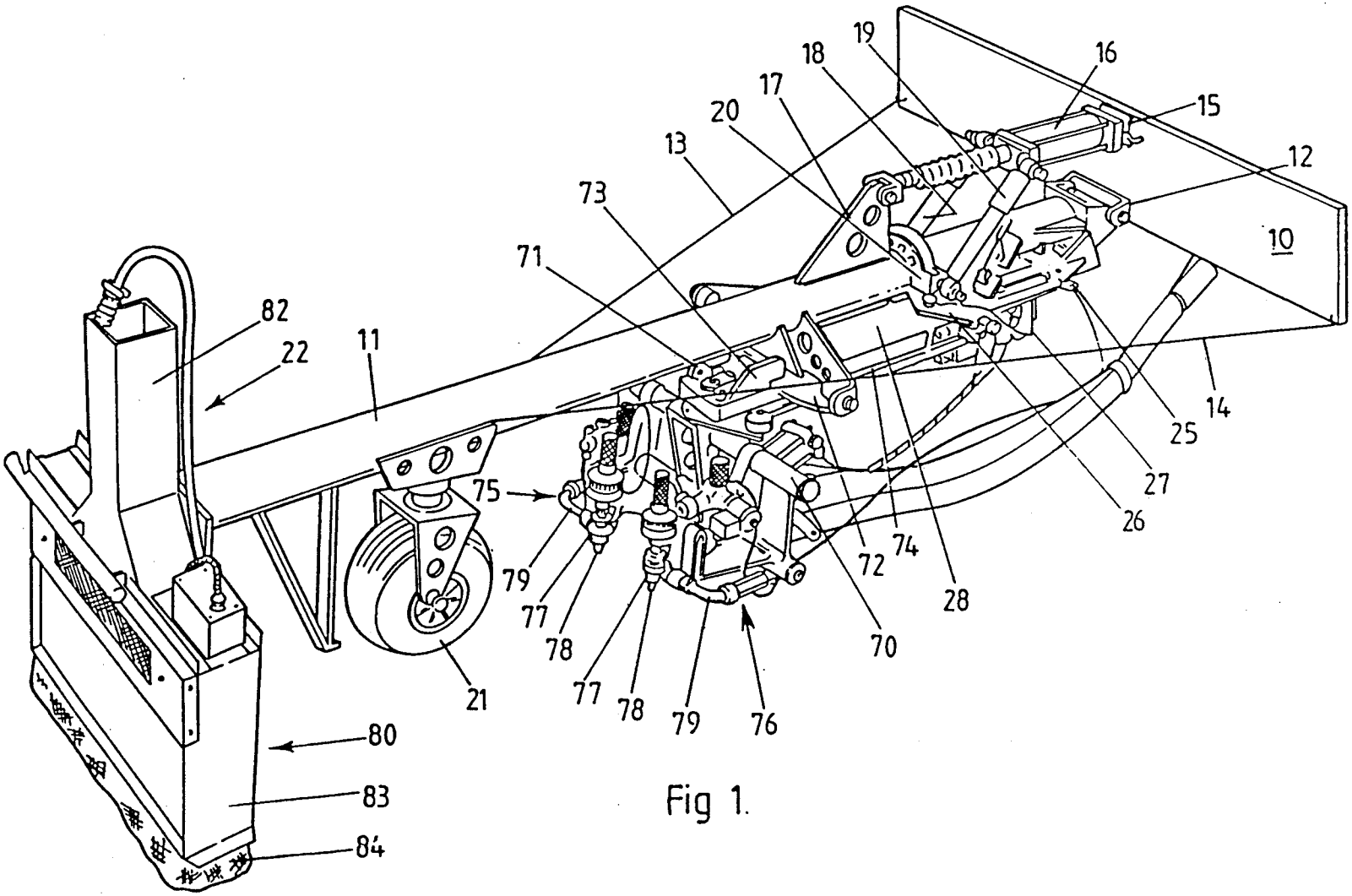
FIG. 1 is a schematic perspective view of line marking apparatus according to the present invention.

Referring now to FIG. 1 there is shown a frame member 10 adapted to be connected to the front of a vehicle such as a truck, the frame member 10 extending transversely across the front of the vehicle. Arranged centrally and extending forwardly from the frame member 10, is a main support boom 11. The boom 11 is pivotally mounted at 12 to the frame member 10 whereby it is adapted to pivot about a substantially transverse horizontal axis. A pair of lateral stay members 13 and 14 are connected to the boom at forward positions and extend therefrom to lateral ends of the frame member 10 whereby the boom 11 is substantially prevented from pivoting or flexing transversely, that is about a vertical axis.

Centrally located above the pivot mounting 12 is a mounting 15 and a lifting cylinder 16 is provided extending between the mounting 15 and an upwardly extending bracket 17 fixed to the boom 11. Actuation of the lifting cylinder 16 will enable the boom to be lifted out of ground engagement for transport purposes. Furthermore, a pair of shock absorbers 18, 19 are provided between the cylinder 16 and a transversely extending bracket 20 connected to the boom 11. The shock absorbers 18, 19 permit limited vertical pivotal movement of the boom in consequence to road undulations or the like but will act to always maintain the boom correctly positioned relative to the road surface under surveillance. Furthermore, a supporting castor wheel 21 is provided adjacent to but spaced from the forward end 22 of the support boom 11. The castor wheel is adapted to maintain both the paint applicators and the line detection equipment hereinafter described at a substantially fixed height above the pavement thereby controlling the width of the painted line and the width of pavement scan by the line detection equipment.

Figure 1B:
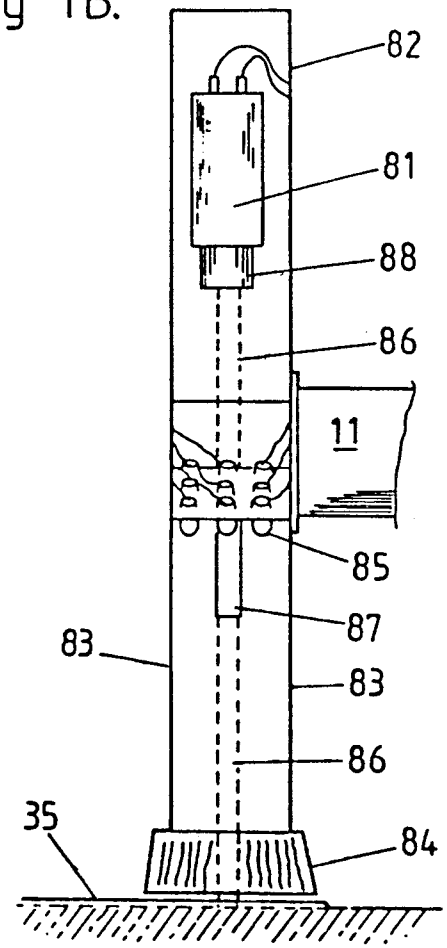
FIG. 1B is a side elevation view of the equipment shown in FIG. 1A.
Figure 1A:
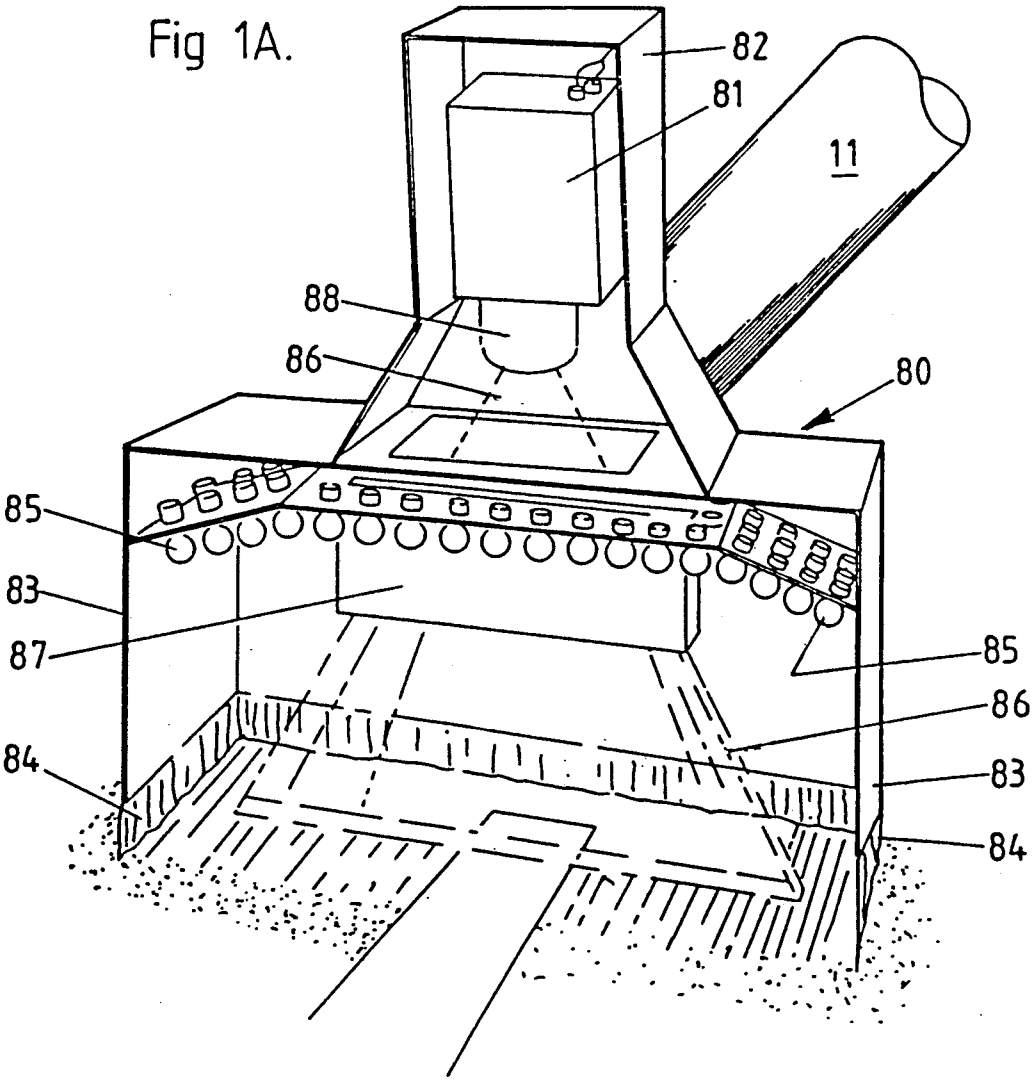
FIG. 1A is a schematic perspective view of the line detection equipment of FIG. 1 showing internal features thereof.

Arranged at the forward end 22 of the boom 11 there is provided line detection equipment 80. This equipment is also shown in more detail in FIGS. 1A and 1B. The equipment comprises a line scan camera 81 mounted in an upper region 82 of a substantially enclosed housing 83 The housing 83 is open at its side facing towards the road surface and at this side includes a downwardly depending surrounding flexible skirt 84 (to minimize light variations from sources outside of the housing 83). Within the housing 83 there is provided an independent light source 85 formed in the illustrated embodiment by a plurality of globes which provides a constant illumination to the road surface traversed by the housing 83 regardless of external lighting conditions. The line scan camera 81 has an essentially transverse field of view 86 which extends downwardly through a similar shaped shroud 87 extending to a level beneath the source of illumination 85. The transverse extends substantially across the width of the housing 83 whereby the driver of the vehicle to which the boom 11 is mounted simply ensures that the housing 83 traverses any old road lines 35 for the camera 81 to be able to sense their presence.

The line scan camera 81 may typically be a Reticon LC600 line scan camera (trade name) marketed by E. G. & R. Reticon of Sunnyvale, Calif., United States of America. The camera is of similar size to an ordinary photographic camera and its operation is analogous to photographic cameras with the exception that the film plane is replaced by a linear array of tiny photodiodes. The photodiodes are arranged in a line with very small centre to centre spacing such that the field of view line 86 scanned by the camera 81 comprises a line transverse to the direction of travel, that is transverse to the boom 11. The field of view of the camera 81 is imaged by the camera lens 88 onto the photodiode array which is scanned electronically to produce a train of analog electrical pulses each having an amplitude proportional to the light intensity of the corresponding photodiode. These pulses are then compared to a preset threshold level to produce a train of binary pulses (logical zero for light below threshold (black) and logical one for light above threshold (white)). This type of camera scans virtually instantaneously with respect to the time limits necessary within the system. Normal Vidicon tube cameras (TV cameras) are unsuitable at the intended speeds of operation as they suffer from excessive persistence, that is, when the light signal is removed, the output signal from the camera takes too long to decrease to zero which would result in inaccurate turning on and off of the spray guns.

Figure 2:
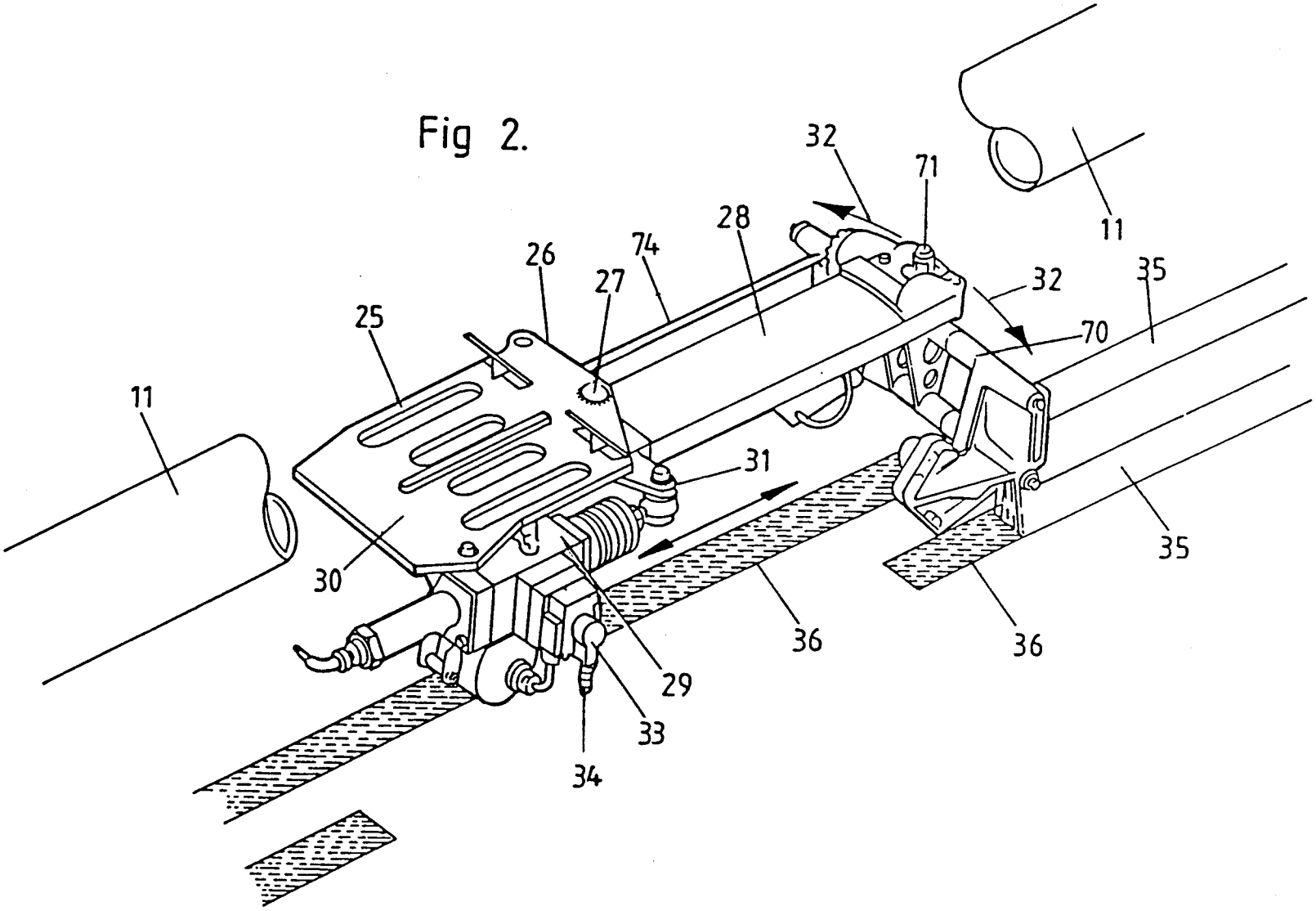
FIG. 2 is a detailed schematic view of a portion of FIG. 1 with some parts removed for the sake of clarity.

As is best shown in FIG. 2 and to a lesser extent in FIG. 1, there is provided a fixed mounting plate 25 connected to the boom 11 adjacent to the pivot connection 12 of the boom to the frame member 10. At the forward end 26 of the plate 25 there is provided a pivot means 27 having a vertical pivot axis and which connects a generally longitudinally extending pivot arm 28 to the mounting plate 25. From the forward end of the pivot arm 28, a transverse arm 70 is pivotally mounted about a pivot 71. The arm 70 acts as a carrier for transversely spaced paint/glass bead applicators 75,76. In spray gun 77 located forwardly in the direction of travel and a glass bead dispensing valve 39 located rearwardly of but in line with its associated spray gun 88 whereby, if desired, glass beads may be deposited directly onto freshly sprayed paint. An arcuate plate 72 is fixed to the boom 11 and acts as a bearing plate for support lugs 73 connected to the forward end of the arm 28. In FIG. 2 the glass bead dispensing nozzles 39 have been removed for the sake of clarity. Arranged immediately beneath the plate 25 and towards one side of the plate there is provided an actuating hydraulic cylinder 29. The cylinder 29 is pivotally mounted to a rear end 30 of the plate 25 and is pivotally connected to a lateral lug 31 of the pivot arm 28. On the side opposite to the cylinder 29 there is provided a generally parallel strut 74 pivotally connected to the boom 11 and to the transverse arm 70. In this manner actuation of the cylinder 29 will swivel the pivot arm 28 about the pivot means 27 while the strut 74 maintains a parallelogram action ensuring the spray guns only move transversely or sideways instead of rotating, the movement being in the direction of the arrows 32. This action ensures that the line width sprayed by the spray guns remains constant. The actuating cylinder 29 has a servo valve 33 associated therewith which is actuated by a spray gun side shift servo control 91 in response to a signal conveyed by line 34 from a data processor 90 processing information received from the line detection equipment 80. In this manner the spray guns 77 are accurately and automatically positioned over the old lines 35 to provide repainted lines 36.

Figure 2A:
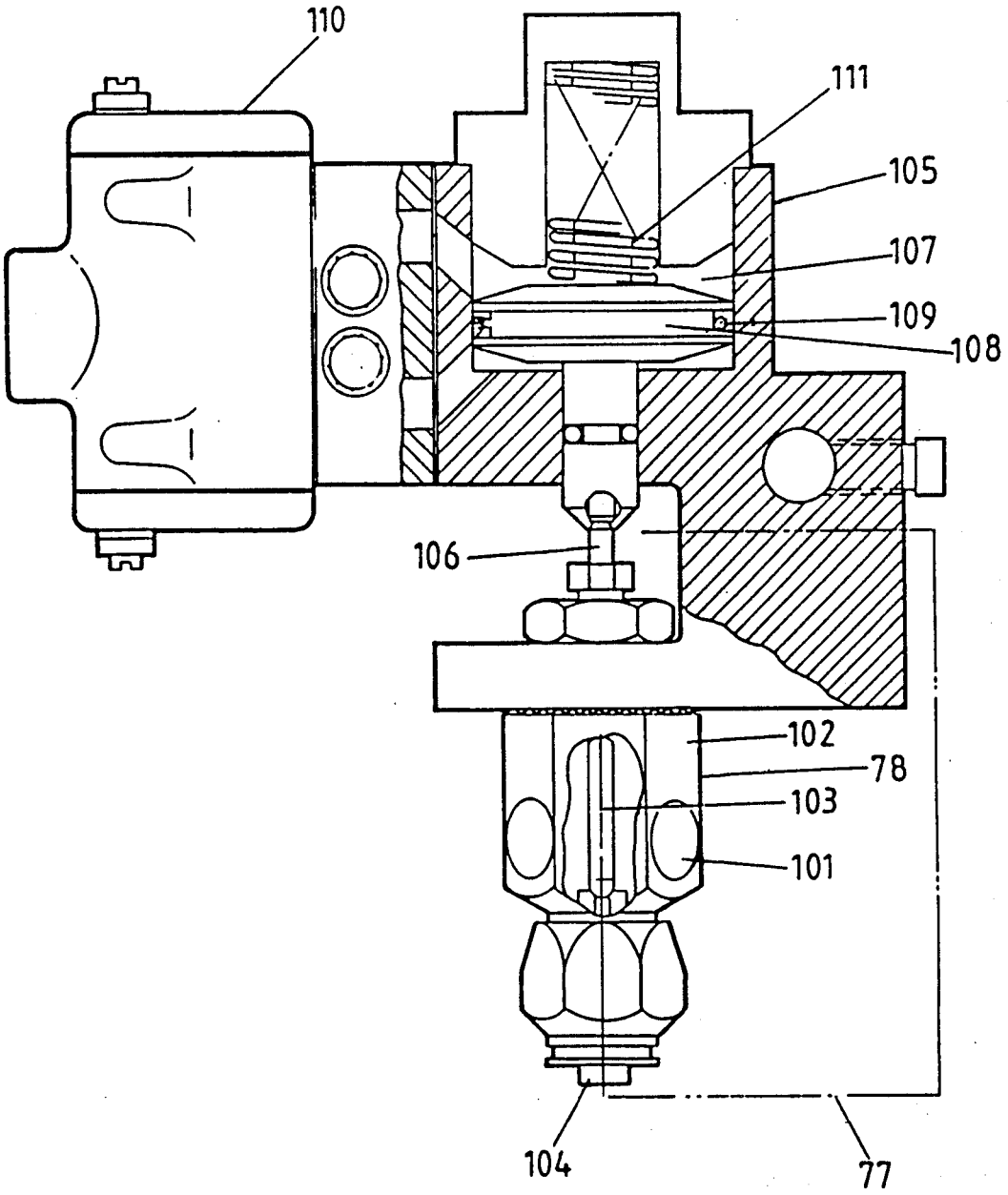
FIG. 2A is a detailed view of a preferred paint applicator different to that shown in FIG. 1 with portions removed for greater clarity.

The paint spray guns 77 are shown in detail in FIG. 2A. The spray guns comprise essentially a conventional standard airless spray gun 78 to which heated paint is supplied via lines 79 from the paint supply system described hereinafter. The paint is supplied via lines 79 through ports 101 in the gun body 102. A needle valve 103 controls the flow of paint to the spray jet outlet 104 whereby paint is supplied to the desired road surface area. Movement of the needle valve 103 is effected positively in both directions by a double acting air cylinder 105, connected to the needle valve 103 by a connecting rod 106. The double acting air cylinder 105 comprises a low air volume cylinder 107 and a control piston 108 having low friction bearings 109 contacting the wall of the cylinder 107. A pneumatic air control valve 110 of substantially conventional design is bolted directly to the body of the cylinder 105 such no connecting lines are required from the valve to the air actuating cylinder 107. A spring element 111 is provided to close the needle valve 103 should the air supply to the system fail. Conveniently the spray guns 77 are produced from light metal such as aluminium whereby the weight of the gun together with its associated control elements is maintained at a minimum. Furthermore, this light weight, minimum friction in the control elements and minimum distances for actuating air to flow result in a quick acting paint spray gun required for reasons which will hereinafter be explained.

Figure 6:
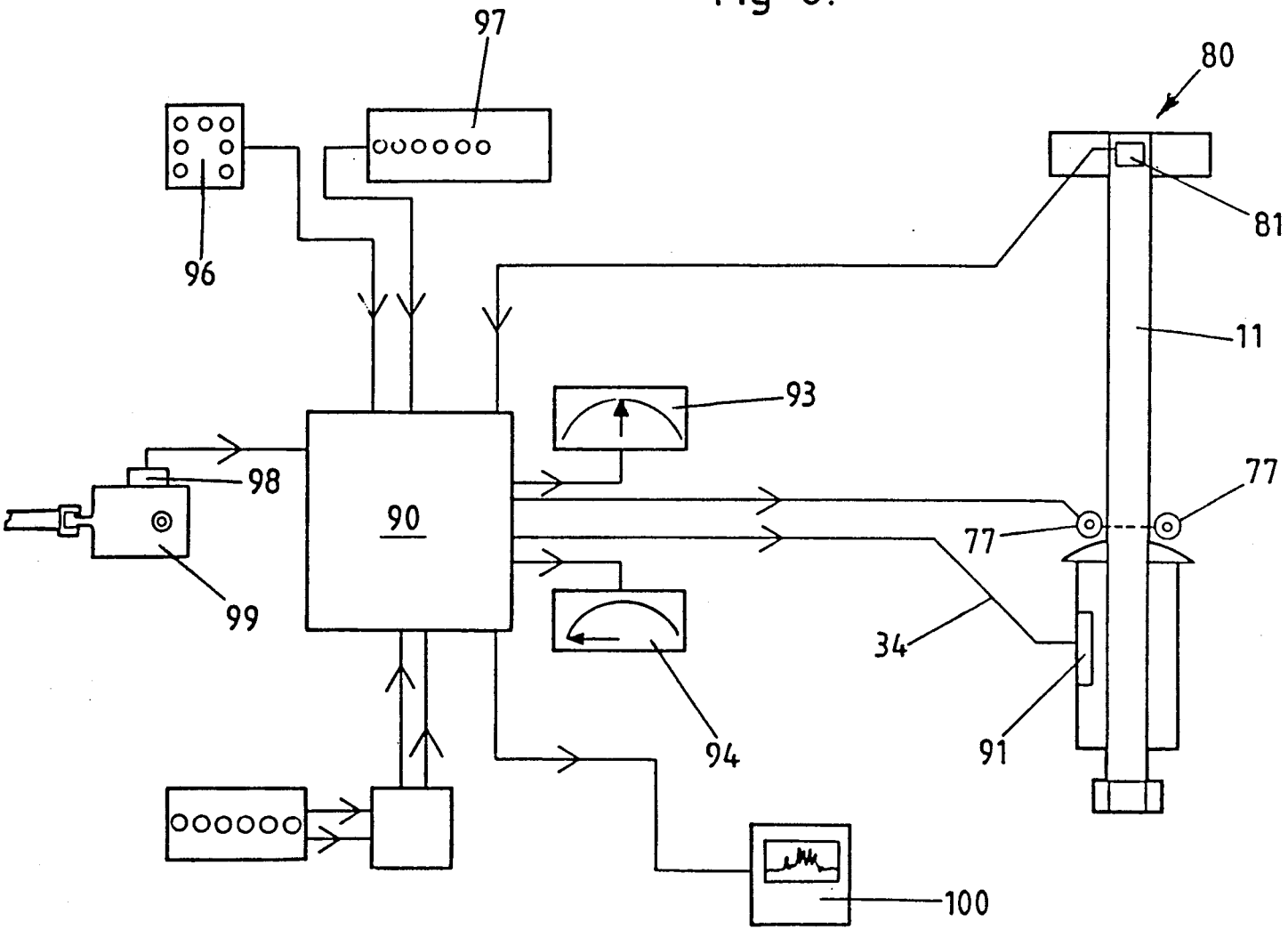
FIG. 6 is a schematic flow diagram showing generally the control system associated with the apparatus of FIGS. 1 to 3.

The preferred line detection system of the present invention includes an electronic digital data processor 90 (FIG. 6) in operation association via line 92 with the line scan camera 81. The camera 81 is arranged to continuously scan across its field of view 86. In one preferred mode of operation, the road surface has one complete scan every 6 mm of forward travel of the camera and the output signal resulting from this scan is fed into the electronic data processor 90. Because of the substantial variation in light intensity likely to be experienced from worn road lines, a length of road is preferrably sampled by the scanning camera 81 before it can be determined that a line exists. The system may carry out 73 scans at 6 mm each amounting to a 438 mm length of road and this information is continuously held in storage in the digital data processor as the scanning process is continuously repeated. The scan is of a nominal width. To prevent the system from operating due to extraneous light patches on the road (for example paper or paint splashes) the system is arranged to activate the spray guns only when the light patch on the road surface is about 75 mm wide and at least 438 mm long.

The system will work at any speed up to the maximum processing capability of the electronics. The system is arranged such that aspects that are affected by distance are controlled by a distance measuring system whereas aspects which are affected by time are controlled by a time measuring system. If it is desired to work at significantly higher speeds this simply is achieved by increasing the distance travelled between scans, in other words by scanning at 12 mm travel instead of 6 mm. This will result in an instant doubling of the maximum speed of the unit with only a very minor decrease in accuracy.

At a striping speed of 60 km/hr (16.7 m/sec) with the paint spray guns 77 mounted 1200 mm behind the detection camera 81 and with the system requiring 438 mm of line to pass beneath the camera before the electronic system can detect the line and signal the spray guns on, it is necessary to have a combined response time of the pneumatic valve 101 and spray gun 78,105 of 35–40 m sec. That is, the time from the electrical signal being sent to the solenoid of the pneumatic valve 101 to the paint actually striking the road surface. Similarly, the time from the cessation of the electrical signal on the solenoid to the cessation of the paint spray striking the road surface. To achieve this order of response time, the spray guns are required to have individually adjustable on and off response times so that both the on and off response times of both spray guns can be adjusted to the same valve.

This is essential so that the delay time preset in the electronic system will match both response times of both spray guns 77. Without this matching response time, variations in the starting and finishing of the sprayed line would occur.

The spray gun 78,105 and valve 101 assembly must also be as light as possible, to enable a higher rate of response of the sideshift system.

Typically the paint spray gun nozzle valve 78 may comprise the paint section only of a standard Graco airless spray gun with the air cylinder 105 directly coupled to it, the pneumatic valve 101 being bolted directly to the cylinder. The low friction seals 109 are used on the piston 108 of the air cylinder 105 to reduce breakaway friction and hence reduce the time needed for air pressure to build up before the piston starts to move. The direct mounting of the pneumatic valve 101 to the side of the air cylinder 105 enables the air passages between the valve and cylinder to be as short and unrestricted as possible to reduce friction due to flow of air to a minimum, and the volume of the air passages and the air space in the cylinder to be as small as possible. A valve mounted separately from the cylinder and connected with even short lengths of standard pneumatic tubing would not have a fast enough response time. Typically the pneumatic valve 101 may be an Electroaire valve—model number B385-3004.

Whilst a system with a faster response time than that described in the foregoing could be used, it would generally require specially constructed heavy solenoids, a large power supply to drive them and a method of dissipating the heat generated by them. Because of this, the system would have been many times heavier than the preferred embodiment described above. This would have made it impossible to obtain the required response for lateral positioning of the spray guns 77 by the servo system 29,33.

The data processor 90 provides a number of outputs. It will send a signal to switch the spray guns on and off. It will send a signal to the side shift servo system 29,33 to enable it to position the spray guns correctly over the line. It further gives an output display 93 (analogue meter) to the vehicle driver to indicate to the driver the position of the worn line being followed in the field of view of the camera 81 to prevent the line drifting out of view of the camera. It gives a speed indication on an analogue meter 94 to enable the driver to check the speed of the vehicle.

Because of the variation in reflectivity of various types of road surface (i.e. asphalt, aggregate, river gravel, scoria, etc.) it has been found desirable to have an automatic (remote control) aperture for the line scan camera 81. This can be either automatically operated from a light meter or under the control of the operator via control means 96,97. To obtain the best results it is desirable for the background (normal road surface) illumination level to be just below the camera threshold level. Any tendency to be at or above the threshold level will result in spurious spraying whilst if the background illumination is substantially below the threshold level, there will be a tendency to fail to detect badly worn lines. The system operator receives a display of the road surface sensed by the sensing equipment 80 on an oscilloscope 100.

The preferred system of the present invention employs an optical encoder 98 driven from the normal operating vehicle speedometer drive 99. The output from the encoder is fed into the data processor 90 to give the system an accurate signal proportional to the vehicle speed. This signal is used to initiate a scan of the detection camera every 6 mm of vehicle travel; to automatically provide the correct delay to the activation of the spray guns 77 dependent on vehicle speed; to provide a speed (and hence distance travelled) signal to the system for carrying out new work (as opposed to repainting old lines); and to prevent operation of the spray guns if the vehicle speed either falls below a predetermined level (15 km/hr) or exceeds a predetermined level (normally 60 km/hr).

The system also enables painting of new lines on new road works or where the road surface has been resealed obliterating the old lines. The system measures out along the road surface the required spray pattern and this is sprayed automatically. In this mode of operation the vehicle driver simply manually controls the correct lateral positioning of the spray guns by steering the vehicle itself.

Figure 3B:
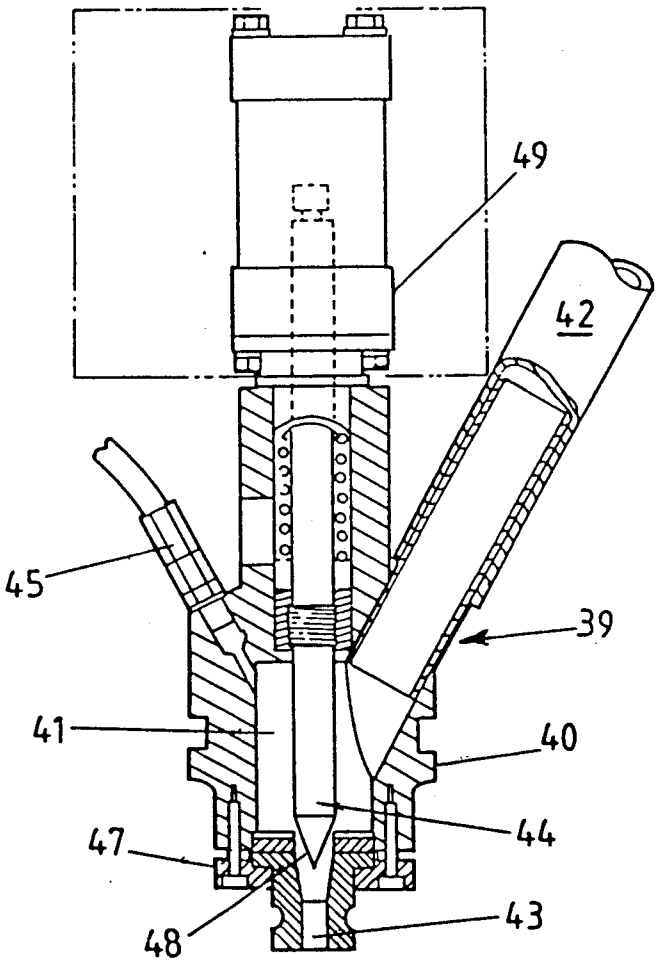
FIG. 3B is a cross-sectional view of one of the glass bead applicators of FIG. 3A.
Figure 3A:
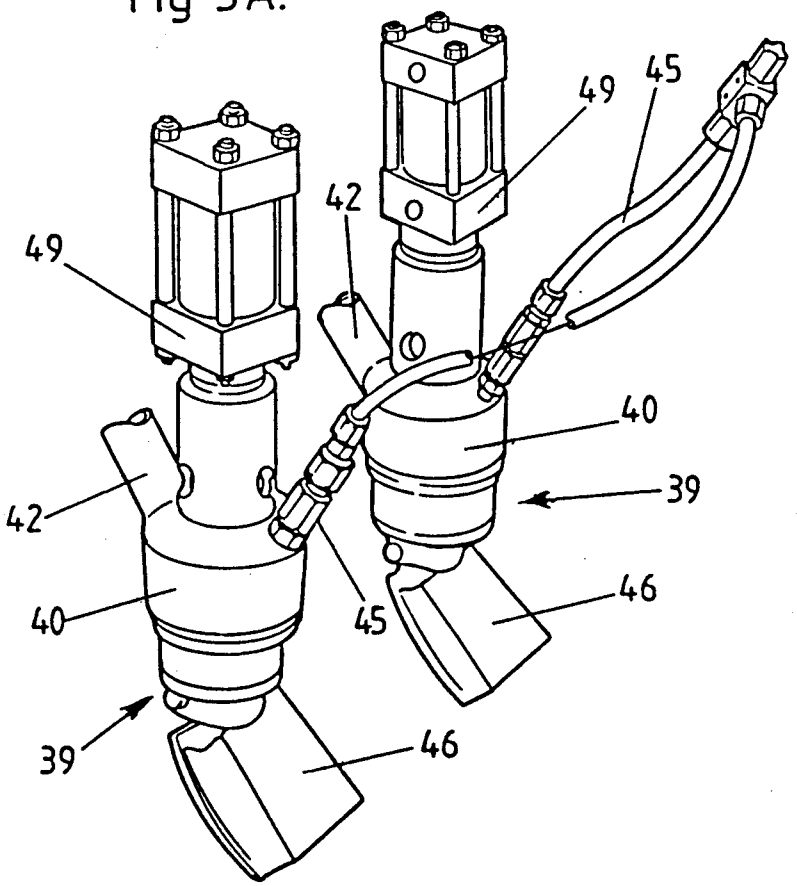
FIG. 3A illustrates two glass bead applicators for use in association with the paint applicators employed in the apparatus of FIGS. 1 and 2.

Referring now to FIGS. 3A and 3B there is shown the glass bead applicator nozzles 39. Glass beads are applied to wet paint immediately after spraying of the paint to provide a luminous or reflective quality to the paint surface. The beads must at least partially be embedded in the paint to provide adequate adhesion. It has been found that simply allowing glass beads to fall from an applicator nozzle provides insufficient directional stability to the stream of glass beads with the result that they tend to disperse or scatter without sticking in the wet paint. This is particularly so in high wind loading conditions. To overcome this problem, the present invention proposes the use of pressurized air directed into the nozzle to provide a strong outflow of glass beads from the nozzle.

Referring now to FIG. 3B there is shown a nozzle housing 40 defining a cavity 41 into which a glass bead delivery tube 42 opens. The tube 42 connects to a pressurized hopper for glass beads carried by the vehicle and shown in FIG. 4B. The nozzles 39 include a nozzle outlet 43 leading from the cavity 41 which can be closed by a plunger element 44. The plunger element 44 includes a needle point 47 engaging with a valve seat 48. The movement of the plunger element is controlled by a conventional pneumatic cylinder and solenoid control 49 in response to signals from the data processor depending on the requirement for delivery of glass beads. When the plunger 44 is retracted glass beads may pass from the delivery tube through the cavity 41, the valve seat 48 and through the outlet 43. When the plunger 44 is extended it engages in the valve seat 48 and prevents the flow of glass beads through the outlet 43. The nozzle further includes a pressurized air line 45 leading into the cavity 41 which provides air at a pressure of 30 to 60 KPa to ensure the rapid even flow of beads through the outlet 43 when the plunger is retracted. As will be appreciated there is provided two bead dispensing nozzles 39, one associated with each paint spray gun 77 and located immediately after the spray guns in the direction of travel of the apparatus as a whole. The nozzles may further include bead director plates 46 located below the outlets 43.

Figure 4A:
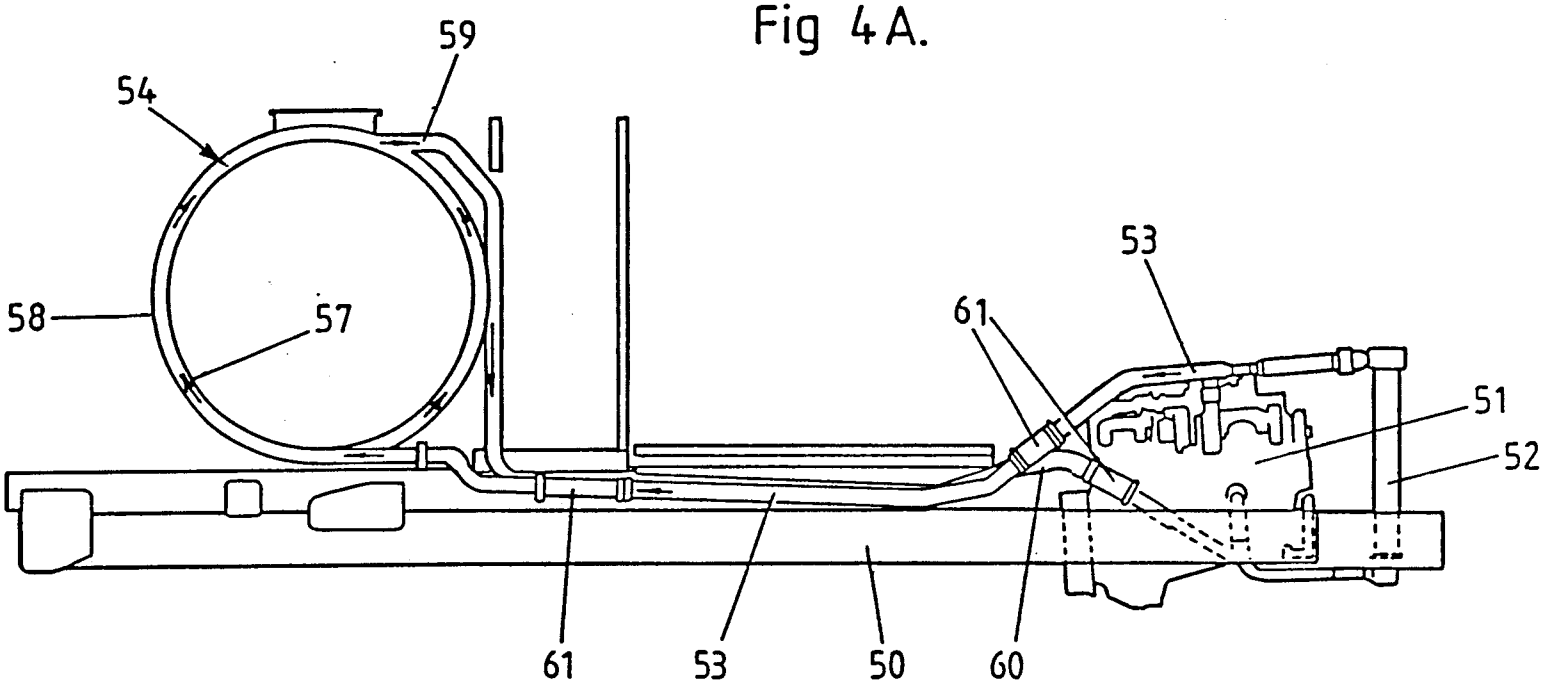
FIG. 4A is a schematic side elevation view of a vehicle chassis and engine carrying the paint storage system according to a preferred aspect of the present invention.
Figure 4B:
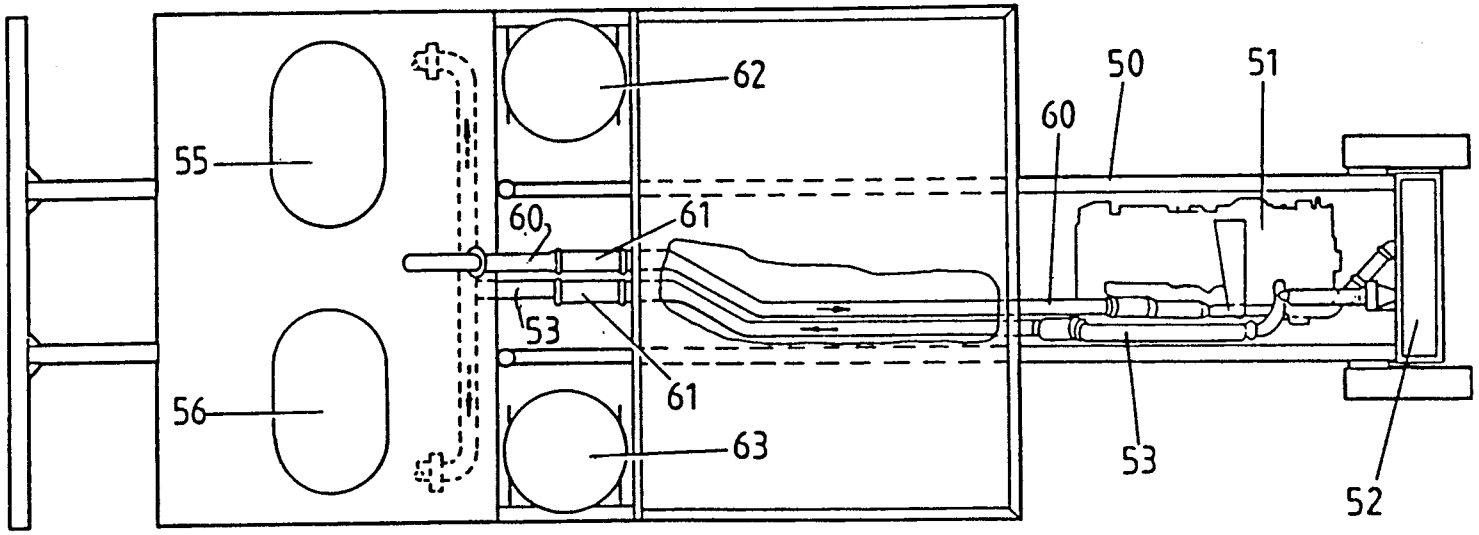
FIG. 4B is a plan view of FIG. 4A.
Figure 5:
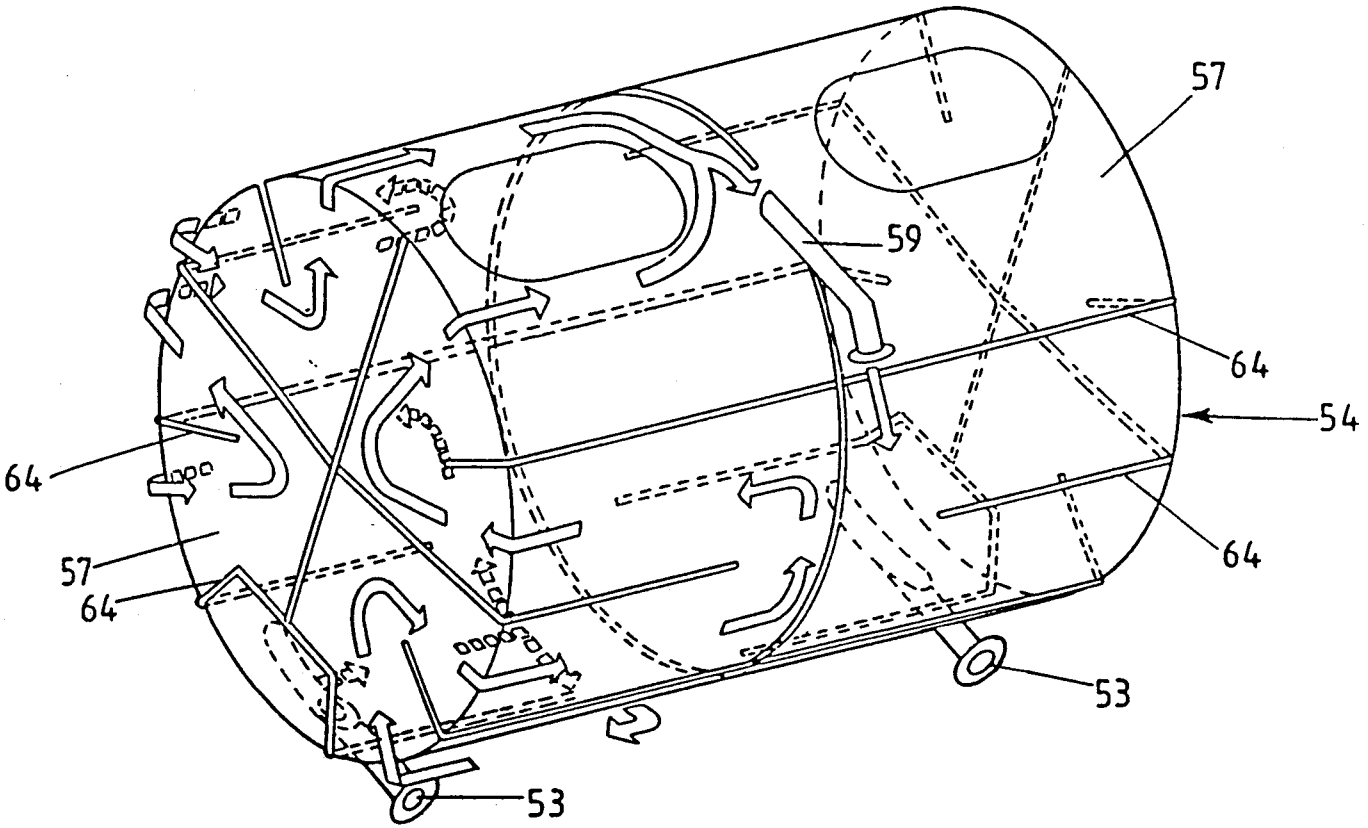
FIG. 5 is a perspective view of the paint container showing the water flow heating system.

Referring now to FIGS. 4A, 4B and 5 there is shown a vehicle chassis 50 adapted to be carried by ground engaging wheels and having a drive engine 51. The vehicle is generally of conventional construction having a normal control cabin and a rear carriage tray supporting the paint and glass bead storage containers. The engine 51 has a conventional water cooled system using a radiator 52. The vehicle includes suitable piping means 53 leading hot water from the engine cooling system to a heating jacket 54 surrounding a pair of separate paint containers 55 and 56.

The hot water is lead via the pipes 53 into a bottom region on either side of the paint heating jacket 54. The heating jacket includes an inner wall 57, an outer wall 58 and a series of baffles 64 which lead the hot water upwardly for subsequent return via a centrally located outlet 59 and piping means 60 leading back to the engine cooling system. The piping system includes suitable expansion elements 61 at certain locations and valving devices whereby when water flows into the heating jacket, water does not also flow through the engine radiator. However suitable temperature sensing elements are provided to allow water flow through the radiator if the engine temperature exceeds a certain level.

By this system the paint is heated to a nominal temperature of 40° C. to achieve the correct and consistent atomization of the paint through the paint spray guns 77. Paint is delivered by a pair of conventional paint pumps (not shown) from the tanks 55,56 to the spray guns 77. The arrangement of having two paint storage tanks 55,56 enables paint to be heated in one of the tanks while the other is used for spraying thereby avoiding waste time for paint heating. The utilization of waste engine heat also avoids the need for any separate energy supply for heating purposes. The paint may also be heated while travelling to a particular work site.

The vehicle also includes a pair of pressurized glass bead storage hoppers 62,63 immediately in front of the paint storage means. Advantageously the paint and the glass beads are stored above the rear wheel axis to provide adequate weight distribution. The vehicle may also include its own crane or lifting means to enable lifting and depositing of paint or beads into the storage means.

We claim:

1. A pavement line marking apparatus comprising support means arranged to travel along said pavement in a desired direction generally corresponding to markings on the pavement, said support means carrying marking detection means adapted to maintain surveillance of a predetermined width of pavement traversed by said detection means, paint applicator means carried by said support means rearwardly of said marking detection means with respect to said desired direction of travel of the apparatus, said paint applicator means being mounted for lateral movement relative to said support means whereby said paint applicator mans are movable in a transverse direction relative to said desired direction of travel, means for moving said paint applicator means laterally relative to said support means, and control means interconnecting said detection means and said means for moving the paint applicator means, said marking detection means being adapted to sense a marking on the pavement traversed and to provide signal means in response thereto, said signal means, via said control means, controlling the movement and positioning of said paint applicator means relative to the marking sensed by said detection means, an independent light source arranged to provide a substantially constant light source to at least the predetermined width of pavement traversed by said detection means, said support means comprising a boom extending forwardly of a vehicle adapted to move said boom along said pavement, said marking detection means being located at a free end of said boom and said paint applicator means being located at an intermediate position along said boom, and wherein a support element is pivoted at a first end to said boom for movement about a generally vertical axis, with said support element extending in a plane generally parallel to and beneath said boom, said paint applicator means being positioned adjacent to the second end of said support element at a distance from said pivot connection and arranged for movement with said support element.

2. Apparatus according to claim 1 wherein said paint applicator means are mounted to a transversely extending carrier pivoted to the second end of the support element for movement about a generally vertical axis, said apparatus further including a second rigid connecting element pivoted at one end to said carrier and to a second end to said boom whereby said carrier, said support element, said connecting element and said boom form a parallelogram linkage such that upon pivoting of said support element about its pivot connection to said boom, said carrier for the paint applicator means is maintained generally perpendicular to said boom.

* * * * *

UNITED STATES PATENT AND TRADEMARK OFFICE

CERTIFICATE OF CORRECTION

PATENT NO. : 5,054,959

DATED : October 8, 1991

INVENTOR(S) : JAMES B.S. WILSON, ROBERT MILLIGAN, ALAN LOUGHRON

It is certified that error appears in the above-identified patent and that said Letters Patent is hereby corrected as shown below:

Column 8, line 63, claim 1, change "mans" to --means--.

Signed and Sealed this

Twenty-eighth Day of December, 1993

*Attest:*

Bruce Lehman

BRUCE LEHMAN

*Attesting Officer*

*Commissioner of Patents and Trademarks*